US009850790B2

(12) United States Patent
Ninomiya

(10) Patent No.: US 9,850,790 B2
(45) Date of Patent: Dec. 26, 2017

(54) INTERNAL COMBUSTION ENGINE EQUIPPED WITH DECOMPRESSION MECHANISM

(71) Applicant: HONDA MOTOR CO., LTD., Tokyo (JP)

(72) Inventor: Yusuke Ninomiya, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 346 days.

(21) Appl. No.: 14/632,579

(22) Filed: Feb. 26, 2015

(65) Prior Publication Data

US 2015/0267576 A1 Sep. 24, 2015

(30) Foreign Application Priority Data

Mar. 19, 2014 (JP) ..... 2014-057070

(51) Int. Cl.
*F01L 13/08* (2006.01)

(52) U.S. Cl.
CPC ..... *F01L 13/08* (2013.01); *F01L 13/085* (2013.01); *F01L 2800/15* (2013.01); *F01L 2820/035* (2013.01)

(58) Field of Classification Search
CPC ..... F01L 13/08; F01L 13/085; F01L 2800/15; F01L 2820/035

(Continued)

(56) References Cited

U.S. PATENT DOCUMENTS 3,362,390 A * 1/1968 Esty ..... F01L 13/085 123/182.1
3,496,922 A * 2/1970 Campen ..... F01L 13/085 123/182.1

(Continued)

FOREIGN PATENT DOCUMENTS

CN 2921297 Y 7/2007
EP 0826476 A1 3/1998

(Continued)

OTHER PUBLICATIONS

Office Action dated Jan. 12, 2017, issued in counterpart Chinese Patent Application No. 201510116653.0, with partial English translation. (9 pages).

(Continued)

*Primary Examiner* — Thomas Moulis
*Assistant Examiner* — John Bailey
(74) *Attorney, Agent, or Firm* — Westerman, Hattori, Daniels & Adrian, LLP

(57) ABSTRACT

An internal combustion includes: a camshaft having a metal core rod insert formed centrally in the camshaft and a driven gear, an exhaust cam, etc. formed of resin integrally with the camshaft; and a decompression mechanism. The decompression mechanism includes: a pair of supporting protrusions provided on the driven gear and each having an insertion hole; a decompression member having a pair of projections disposed between the supporting protrusions; and a biasing spring disposed between the projections for normally biasing the decompression member toward the exhaust cam. The camshaft also has a guide recess and a balancing recess formed in opposite sides of the camshaft, and the metal core rod is exposed through the guide recess and the balancing recess.

2 Claims, 11 Drawing Sheets

(58) Field of Classification Search
USPC ..... 123/182.1, 320, 150, 321
See application file for complete search history.

(56) References Cited

U.S. PATENT DOCUMENTS 3,901,199 A * 8/1975 Smith ..... F01L 13/085 123/182.1
4,184,468 A * 1/1980 Freyn ..... F01L 13/08 123/182.1
4,453,507 A * 6/1984 Braun ..... F01L 13/085 123/182.1
4,590,905 A * 5/1986 Matsuki ..... F01L 13/085 123/182.1
4,898,133 A * 2/1990 Bader ..... F01L 13/085 123/182.1
5,150,674 A * 9/1992 Gracyalny ..... F01L 13/085 123/182.1
5,197,422 A * 3/1993 Oleksy ..... F01L 13/085 123/182.1
5,301,643 A * 4/1994 Garcyalny ..... F01L 13/085 123/198 D
5,632,238 A * 5/1997 Furukawa ..... B60K 6/46 123/179.16
5,653,199 A * 8/1997 Ishiuchi ..... F01L 13/08 123/182.1
5,797,180 A 8/1998 Buchholz
5,809,958 A * 9/1998 Gracyalny ..... F01L 13/085 123/182.1
5,823,153 A * 10/1998 Santi ..... F01L 13/08 123/182.1
6,055,952 A * 5/2000 Gau ..... F01L 13/08 123/182.1
6,223,708 B1 * 5/2001 Kampichler ..... F01L 13/085 123/182.1
6,343,579 B1 * 2/2002 Yasuyama ..... F01L 1/026 123/182.1
6,394,054 B1 * 5/2002 Rado ..... F01L 13/085 123/182.1
6,439,187 B1 * 8/2002 Dietz ..... F01L 13/08 123/182.1
6,474,281 B1 * 11/2002 Walters ..... F01L 1/143 123/90.17
6,494,175 B2 * 12/2002 Gracyalny ..... F01L 1/024 123/182.1
6,536,393 B2 * 3/2003 Novak ..... F01L 13/085 123/182.1
6,539,906 B2 * 4/2003 Rado ..... F01L 13/08 123/179.18
6,547,021 B1 * 4/2003 Kai ..... F01L 1/0532 180/190
6,782,861 B2 * 8/2004 Gracyalny ..... F01L 1/18 123/179.18
6,837,203 B2 * 1/2005 Burger ..... F01L 13/085 123/182.1
6,886,518 B2 * 5/2005 Gracyalny ..... F01L 1/181 123/179.18
6,895,918 B1 * 5/2005 Hiraga ..... F01L 1/022 123/182.1
6,973,906 B2 * 12/2005 Yoshida ..... F01L 13/085 123/182.1
7,137,375 B2 * 11/2006 Maeda ..... F01L 13/085 123/182.1
7,174,871 B2 * 2/2007 Grybush ..... F01L 13/085 123/182.1
7,228,832 B2 * 6/2007 Novak ..... F01L 1/047 123/90.15
7,328,678 B2 * 2/2008 Grybush ..... F01L 13/085 123/182.1
7,699,035 B1 * 4/2010 Havlik ..... F01L 13/085 123/182.1
7,984,703 B2 * 7/2011 Hiraga ..... F01L 1/02 123/182.1
2001/0017119 A1 * 8/2001 Suzuki ..... F01L 13/08 123/182.1
2001/0023673 A1 * 9/2001 Suzuki ..... F01L 13/08 123/90.17
2002/0108596 A1 * 8/2002 Gracyalny ..... F01L 1/18 123/182.1
2003/0000493 A1 * 1/2003 Gracyalny ..... F01L 1/024 123/182.1
2003/0217722 A1 * 11/2003 Kobayashi ..... F01L 13/085 123/182.1
2004/0139940 A1 * 7/2004 Tsubouchi ..... F01L 13/085 123/182.1
2005/0161012 A1 * 7/2005 Maeda ..... F01L 13/085 123/182.1
2006/0048736 A1 * 3/2006 Sugiura ..... F01L 1/053 123/182.1
2006/0272607 A1 * 12/2006 Grybush ..... F01L 13/085 123/182.1
2007/0074694 A1 * 4/2007 Grybush ..... F01L 13/085 123/182.1
2008/0202455 A1 * 8/2008 Diggs ..... F01L 1/18 123/90.15
2009/0064958 A1 * 3/2009 Krueger ..... F01L 13/085 123/182.1
2009/0301419 A1 * 12/2009 Hiraga ..... F01L 1/02 123/90.31

FOREIGN PATENT DOCUMENTS

JP 57-99225 A 6/1982
JP 8-121130 A 5/1996
JP 2002-235516 A 8/2002

OTHER PUBLICATIONS

Extended (Supplementary) Search Report dated Sep. 2, 2015, issued in counterpart European Application No. 15159346.4 (4 pages).

* cited by examiner

INTERNAL COMBUSTION ENGINE EQUIPPED WITH DECOMPRESSION MECHANISM

FIELD OF THE INVENTION

The present invention relates to an internal combustion engine equipped with a decompression mechanism for securing appropriate activation of the internal combustion engine.

BACKGROUND OF THE INVENTION

Among the conventionally-known internal combustion engines equipped with a decompression mechanism is one disclosed, for example, in Japanese Patent Application Laid-Open Publication No. 2002-235516 (hereinafter referred to as "the relevant patent literature"), in which a pair of supporting protrusions each having an insertion hole, is formed on a gear of a camshaft and in which a decompression member and a biasing spring are supported on a support shaft inserted through the respective insertion holes of the supporting protrusions. The decompression member is pivotably supported on a portion of the support shaft located between the pair of supporting protrusions. Further, the camshaft has a guide recess formed in a side of its peripheral surface opposed to the decompression member. The decompression member can move appropriately by an actuating section of the decompression member being moved along the guide recess.

Further, in the internal combustion engine disclosed in the relevant literature, a biasing spring, which is provided on a portion of the support shaft between the pair of supporting protrusions, normally biases the actuating section of the decompression member toward an actuating position. The actuating section is kept in a state where it adjoins a cam of the cam shaft and slightly projects beyond the cam, so that a push rod is slightly raised by the actuating section to keep an exhaust valve in a slightly-opened position so as to allow a starting or activating operation of the internal combustion engine to be performed in an appropriate manner. Once the internal combustion engine reaches a predetermined number of rotations, the decompression member moves, by centrifugal force, to a retracted position remote from the cam so that the push rod is no longer raised by the actuating section. In this way, the exhaust valve and an intake valve of the internal combustion engine can be opened and closed appropriately, with the result that the internal combustion engine can be driven in an appropriate manner.

However, because the biasing spring of the decompression mechanism extends to be located outside the pair of supporting protrusions, it is difficult to reduce the size of, or downsize, the decompression mechanism disclosed in the relevant patent literature; in this respect, the internal combustion engine disclosed in the relevant patent literature has a room for improvement. Further, in the decompression mechanism disclosed in the relevant patent literature, the guide recess is formed in one side of the outer peripheral surface of the camshaft for permitting appropriate movement of the decompression member. The presence of such a guide recess in the one side of the camshaft would make it difficult to keep smooth rotation of the camshaft; in this respect, the internal combustion engine disclosed in the relevant patent literature has another room for improvement.

SUMMARY OF THE INVENTION

In view of the foregoing prior art problems, it is an object of the present invention to provide an improved internal combustion engine equipped with a decompression mechanism which has a reduced size and can keep smooth rotation of the camshaft.

In order to accomplish the above-mentioned object, the present invention provide an improved internal combustion engine, which comprises: a camshaft having a metal core rod insert formed centrally in the camshaft, the camshaft also having a gear section and a cam section both formed integrally with the camshaft; and a decompression mechanism for securing activation of the internal combustion engine, the decompression mechanism including: a pair of supporting protrusions provided on the gear section and each having an insertion hole formed therethrough; a support shaft inserted through the insertion holes of the pair of supporting protrusions; a decompression member pivotably supported on the support shaft and having a pair of projections disposed between the pair of supporting protrusions, the decompression member being movable toward and away from the cam section; and a biasing spring supported on a portion of the support shaft between the pair of projections for normally biasing the decompression member toward the cam section, the camshaft also having: a guide recess formed in a side of the camshaft opposed to the decompression member and between the gear section and the cam section so that the decompression member is slidable along the guide recess; and a balancing recess formed in another side of the camshaft opposite the guide recess, the metal core rod being exposed through the guide recess and the balancing recess.

According to the present invention, the pair of the projections provided on the decompression member is located between the pair of supporting protrusions, and the biasing spring is disposed in a space between the pair of the projections. Namely, the biasing spring is disposed in the space that has never been used in the conventionally-known counterparts. Thus, in the present invention, there is no need to provide the biasing spring outside the pair of supporting protrusions, and thus, downsizing (reduction in size) of the decompression mechanism can be achieved.

Further, between the gear section and the cam section of the camshaft, the guide recess is formed in the side of the cam shaft opposed to the decompression member, and the balancing recess is formed in the other side of the camshaft opposite the guide recess. With the guide recess and the balancing recess provided on the opposite sides of the camshaft, a position of the center of gravity of the camshaft between the gear section and the cam section is maintained at the center of the camshaft. In this way, the rotation of the camshaft can be kept smooth during driving of the internal combustion engine.

Further, the metal core rod is insert formed centrally in the camshaft, which can secure sufficient rigidity and strength of the camshaft despite formation of the guide recess and the balancing recess in the opposite sides of the camshaft.

Furthermore, the metal core rod is exposed through the guide recess. Thus, when the decompression member is to be moved toward or away from the cam section, the decompression member can be slid along the core rod. Thus, the sliding movement of the decompression member can effectively prevent abrasion of the camshaft, so that durability of the decompression mechanism can be increased. In addition, with the guide recess and the balancing recess provided on the opposite sides of the camshaft, the camshaft can be reduced in weight.

In a preferred implementation, the pair of supporting protrusions is molded of resin, the decompression member is formed of a metal material, and the projections of the decompression member project outwardly beyond the supporting protrusions. More specifically, the projections each have an outer peripheral protruding portion. Thus, by the projections being extended outwardly of the supporting protrusions, the outer peripheral protruding portions can be located outwardly of the supporting protrusions. In this way, the present invention can prevent respective end corner portions of the projections from contacting and abrading the supporting protrusions.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

Figure 1:
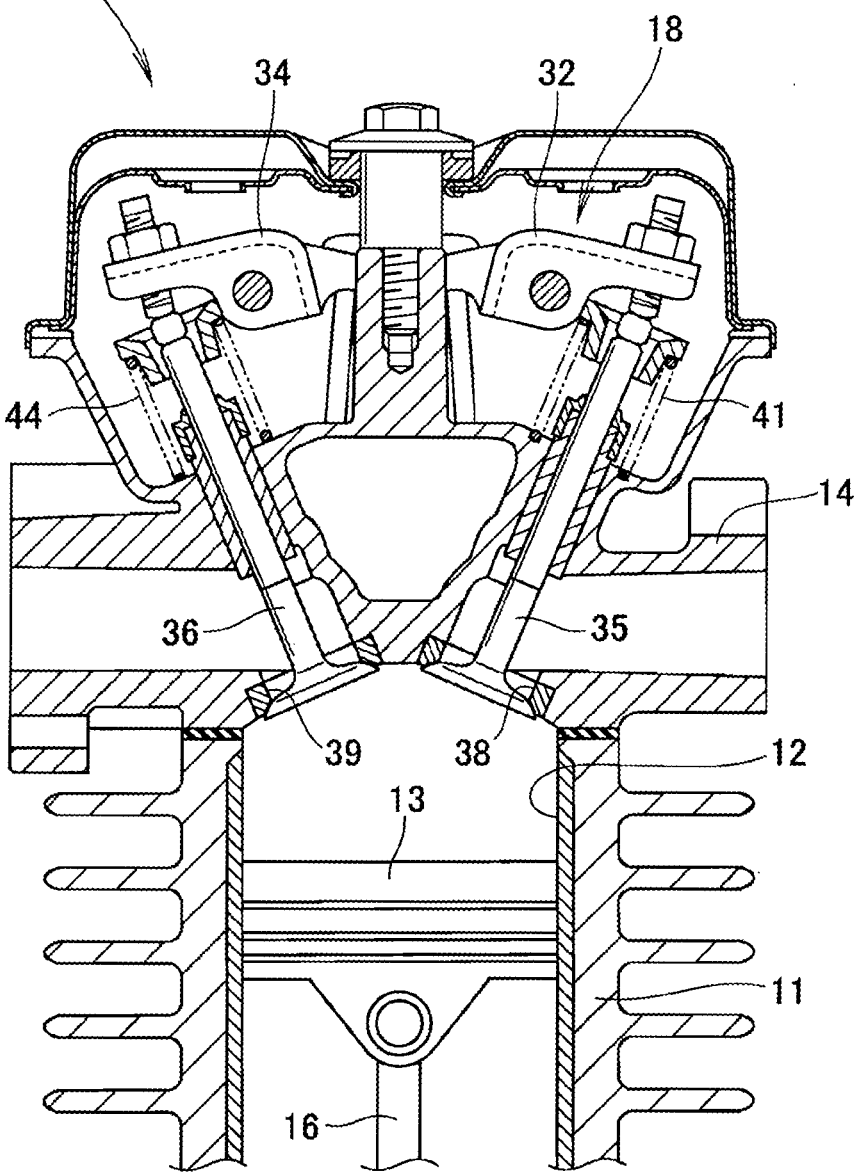
FIG. 1 is a sectional view showing an internal combustion engine equipped with a decompression mechanism according to an embodiment of the present invention.
Figure 2:
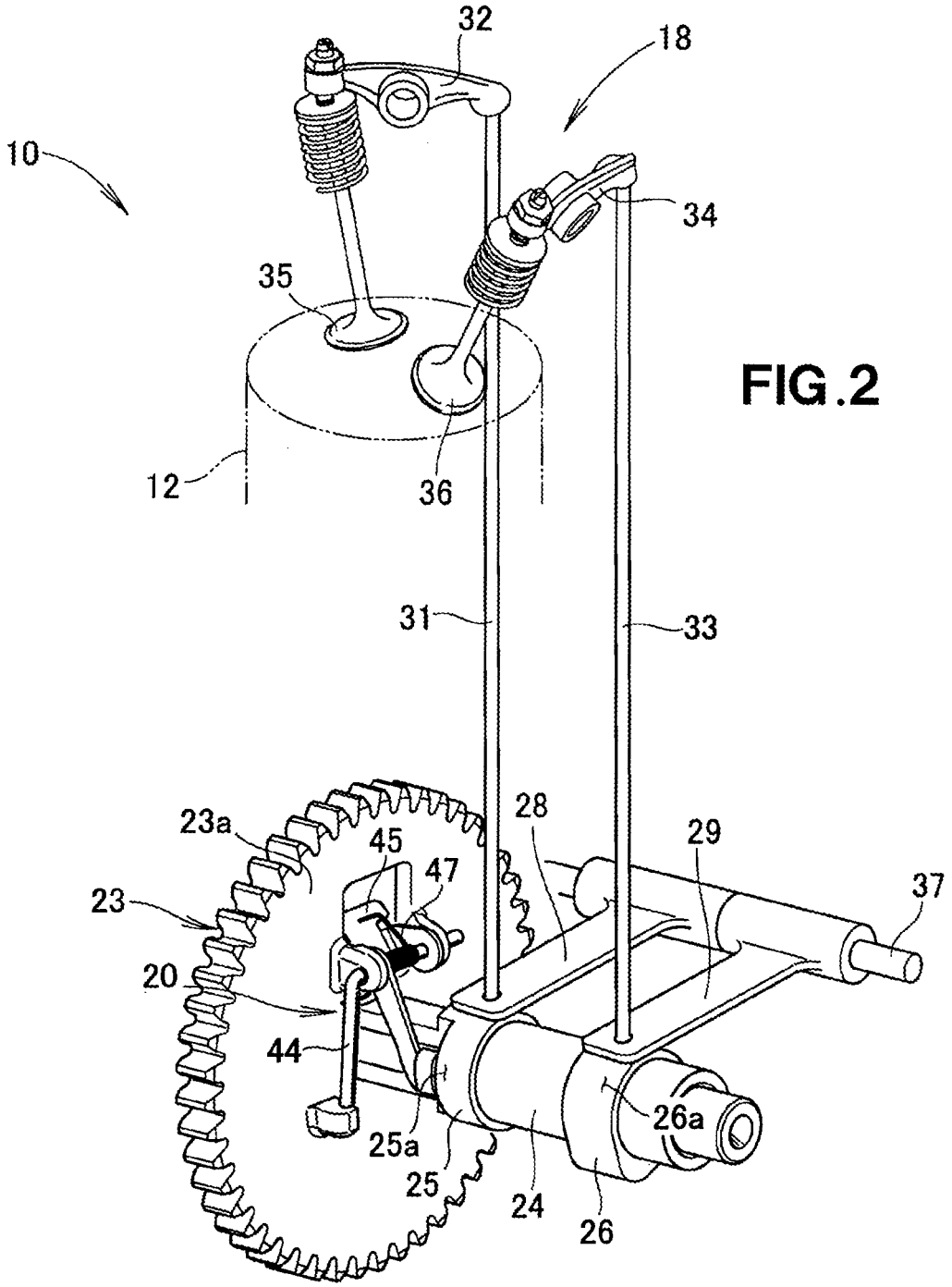
FIG. 2 is a perspective view showing a concept of the internal combustion engine of FIG. 1.

FIG. 1 is a sectional view showing an internal combustion engine 10 equipped with a decompression mechanism according to an embodiment of the present invention, and FIG. 2 is a perspective view showing a concept of the internal combustion engine 10. The internal combustion engine 10 is, for example, an internal combustion engine for an electric power generator As shown in FIGS. 1 and 2, the internal combustion engine 10 includes: a cylinder block 11 having a cylinder 12 formed therein; a cylinderhead 14 provided at the top of the cylinder block 11; a con rod 16 interconnecting a piston 13 and a crankshaft; a valve mechanism 18 connected to the crankshaft; and a decompression mechanism 20 connected to the valve mechanism 18.

The valve mechanism 18 includes: a driven gear (gear section) 23 held in meshing engagement with a driving gear of the crankshaft; a camshaft 24 supporting the driven gear 13; an exhaust cam (cam section) 25 and an intake cam 26 provided on the camshaft 24; an exhaust lifter 28 held in contact with the cam surface 25*a* of the exhaust cam 25; and an intake lifter 29 held in contact with the cam surface 26*a* of the intake cam 26. The valve mechanism 18 further includes: an exhaust rocker arm 32 to which the exhaust lifter 28 is connected via an exhaust push rod 31; an intake rocker arm 34 to which the intake lifter 29 is connected via an intake push rod 33; an exhaust valve 35 connected to the exhaust rocker arm 32; and an intake valve 36 connected to the intake rocker arm 34.

In the valve mechanism 18, the cam shaft 24 rotates together with the driven gear 23 as the driving gear is rotated by the crankshaft. Such rotation of the cam shaft 24 rotates the exhaust cam 25 and the intake cam 26. In response to the rotation of the exhaust cam 25, the exhaust lifter 28 is pivoted, by the cam surface 25*a* of the exhaust cam 25, about a lifter shaft 37 vertically or in an up-down direction. Such vertical pivoting movement of the exhaust lifter 28 is transmitted to the exhaust rocker arm 32 via the exhaust push rod 31. Thus, the exhaust rocker arm 32 is actuated, in response to which the exhaust valve 35 is actuated so that an exhaust opening 38 is opened and closed through cooperation between the exhaust valve 35 and an exhaust valve spring 41.

Further, in response to the rotation of the intake cam 26, the intake lifter 29 is pivoted about the lifter shaft 37 vertically by the cam surface 65*a* of the intake cam 26. Such vertical pivoting movement of the intake lifter 29 is transmitted to the intake rocker arm 34 via the intake push rod 33. Thus, the intake rocker arm 34 is actuated, in response to which the intake valve 36 is actuated so that an intake opening 39 is opened and closed through cooperation between the intake valve 36 and an intake valve spring 44.

Figure 3:
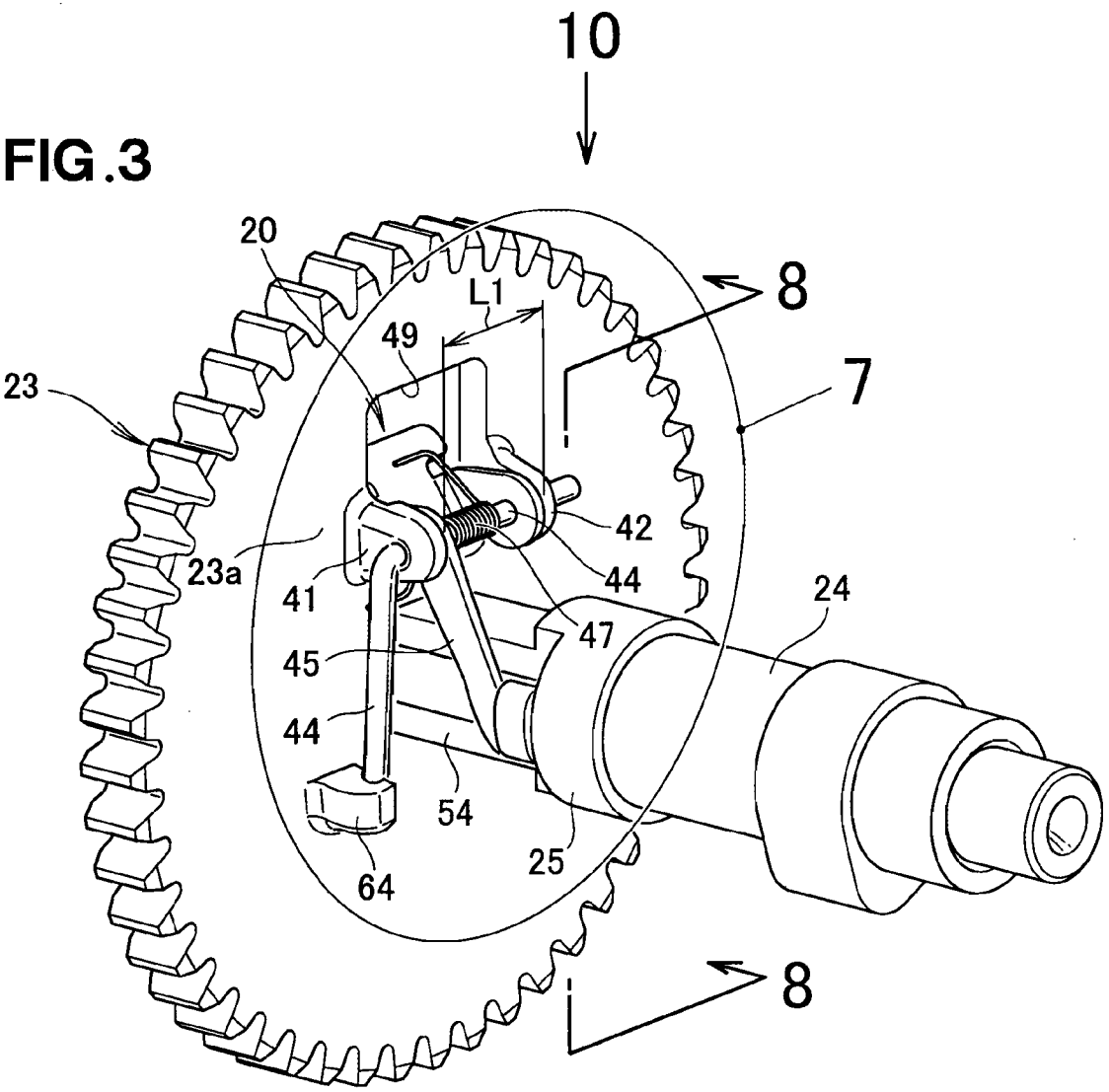
FIG. 3 is a perspective view showing the decompression mechanism of FIG. 2.

As shown in FIG. 3, the decompression mechanism 20 is provided on the driven gear 23, and the decompression mechanism 20 is held in contact with the camshaft 24 and the exhaust cam 25. The decompression mechanism 20 includes: a pair of supporting protrusions 41 and 42 provided on a wall portion 23*a* of the driven gear 23 and spaced apart from each other by a predetermined interval L1 (see FIG. 8); a support shaft 44 supported by the supporting protrusions 41 and 42; a decompression member 45 pivotably supported on the support shaft 44; and a biasing sprint 47 normally biasing the decompression member 45. An opening portion 49 is formed in the wall portion 23*a* of the driven gear 23.

Figure 4:
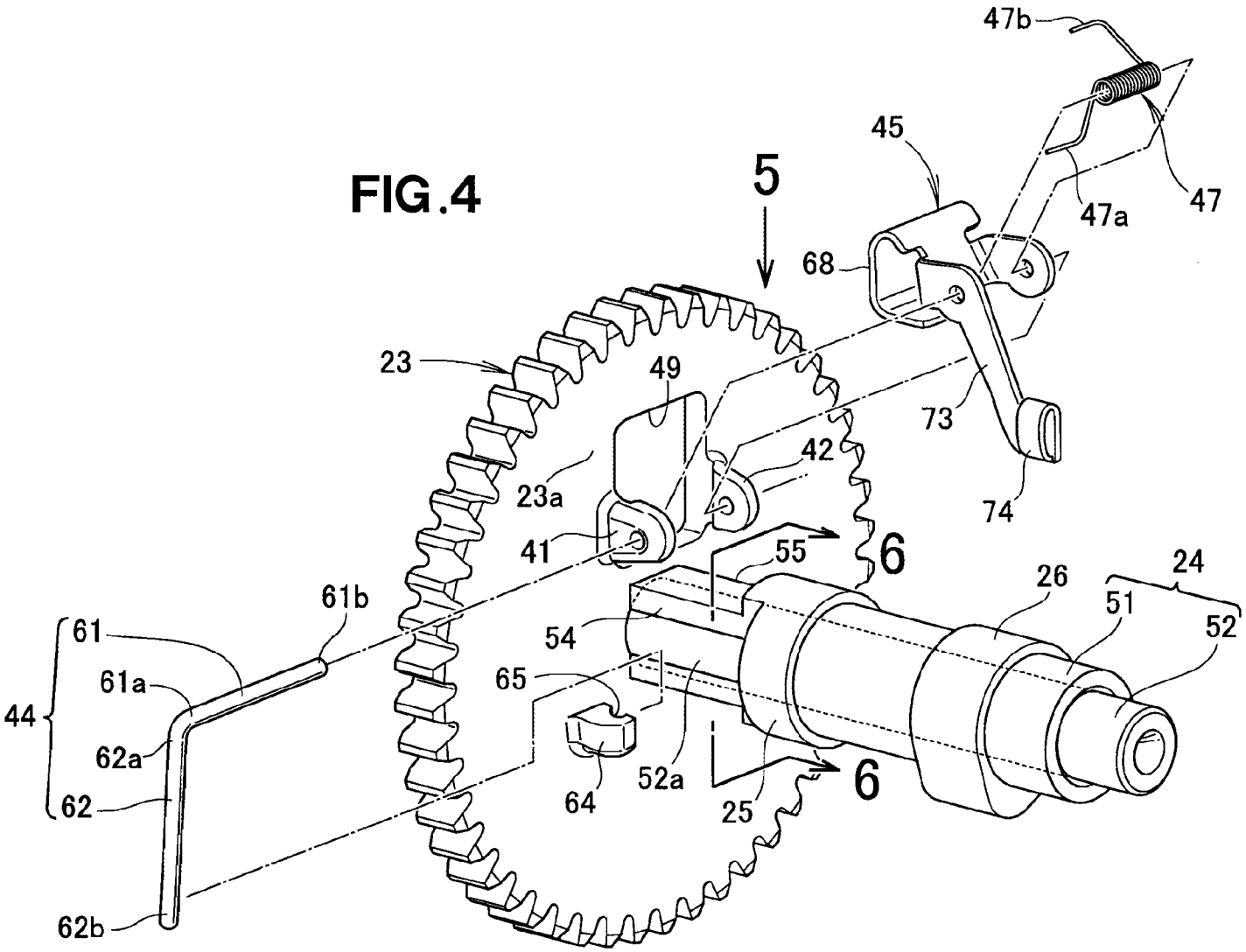
FIG. 4 is an exploded perspective view showing the decompression mechanism of FIG. 3.

As shown in FIG. 4, the camshaft 24 has a metal core rod 52 insert formed centrally therein and having a circular cross-sectional shape. The core rod 52 is covered with an outer shaft portion 51 formed of resin.

The driven gear 23, the exhaust cam 25 and the intake cam 26 are formed of resin integrally with the outer shaft portion 51 when the core rod 52 is covered with the outer shaft portion 51. Namely, the camshaft 24 are formed integrally with the driven gear 23, the exhaust cam 25 and the intake cam 26.

Figure 5:
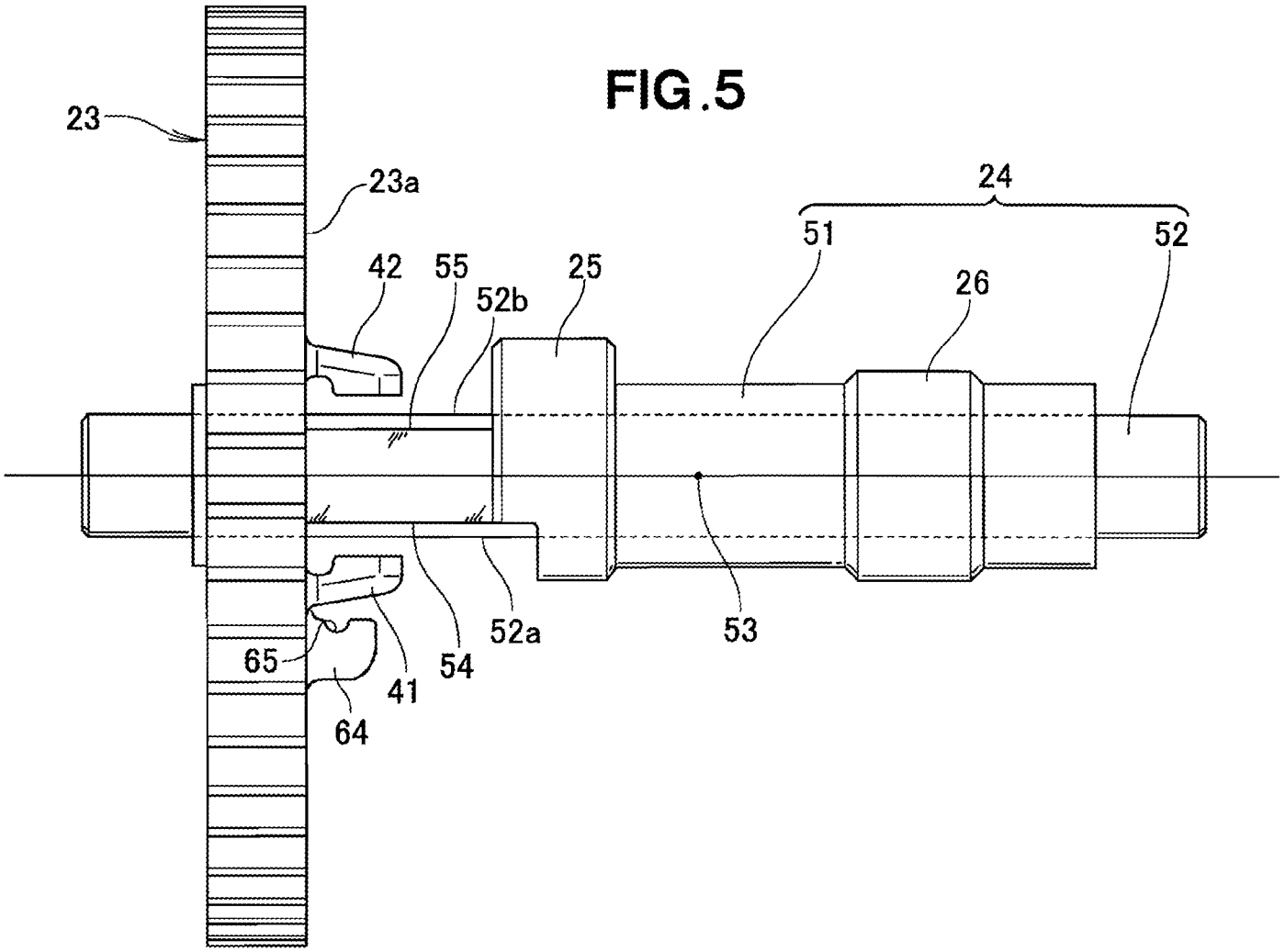
FIG. 5 is a view taken in the direction of arrow 5 of FIG. 4.
Figure 6:
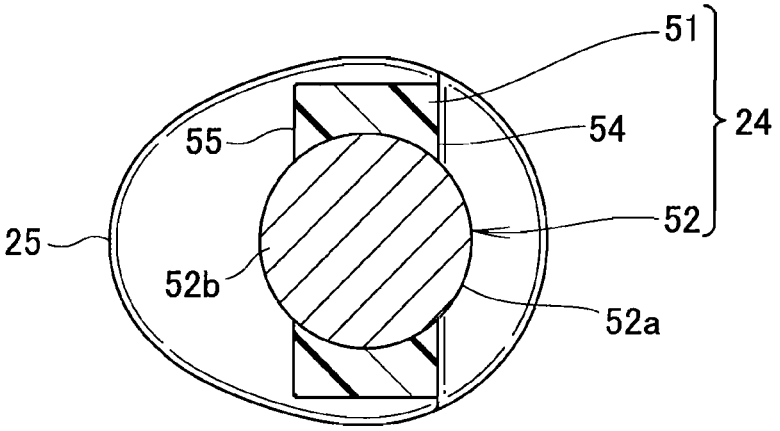
FIG. 6 is a sectional view taken along line 6-6 of FIG. 4.

Further, as shown in FIGS. 5 and 6, the cam shaft 24 has a guide recess 54 and a balancing recess 55 formed therein between the driven gear 23 and the exhaust cam 25 and in symmetric relation to each other with respect to the axis line 53 of the cam shaft 24.

More specifically, the guide recess 54 is formed in an outer peripheral surface of the cam shaft 24 opposed to the decompression member 45 (FIG. 3), so that one outer peripheral side portion 52*a* of the core rod 52 is exposed to the outside through the guide recess 54. The decompression member 45 is slidable along the guide recess 54 and the exposed one outer peripheral side portion 52*a* of the core rod 52. The balancing recess 55 is formed in another outer peripheral surface of the camshaft 24 opposite the guide recess 54, so that another outer peripheral side portion 52*b* of the core rod 54 is exposed to the outside through the balancing recess 55. Hereinafter, the one outer peripheral side portion 52*a* will be referred to as "guide side portion", and the other outer peripheral side portion of the core rod 52*b* will be referred to as "balancing side portion 52*b*".

With the guide recess 54 and the balancing recess 55 provided in the opposite sides of the camshaft 24, a position of the center of gravity of the camshaft 24 between the driven gear 23 and the exhaust cam 25 is maintained at the center (i.e., at the axis line 53) of the camshaft 24. In this way, the rotation of the camshaft 24 can be kept smooth during driving of the internal combustion engine 10. Further, with the guide recess 54 and the balancing recess 55 provided in the opposite sides of the camshaft 24, the camshaft 24 can be reduced in weight.

Further, the camshaft 24 is accommodated within a crankcase and immersed in lubricant oil within the crankcase. Thus, the lubricating oil can be effectively stirred and spread by the guide recess 54 and the balancing recess 55 provided on the opposite sides of the camshaft 24.

Sufficient rigidity and strength of the camshaft 24 can be secured by the metal core rod 52 insert formed centrally in the camshaft 24 although the guide recess 54 and the balancing recess 55 are provided in the opposite sides of the camshaft 24.

Figure 7:
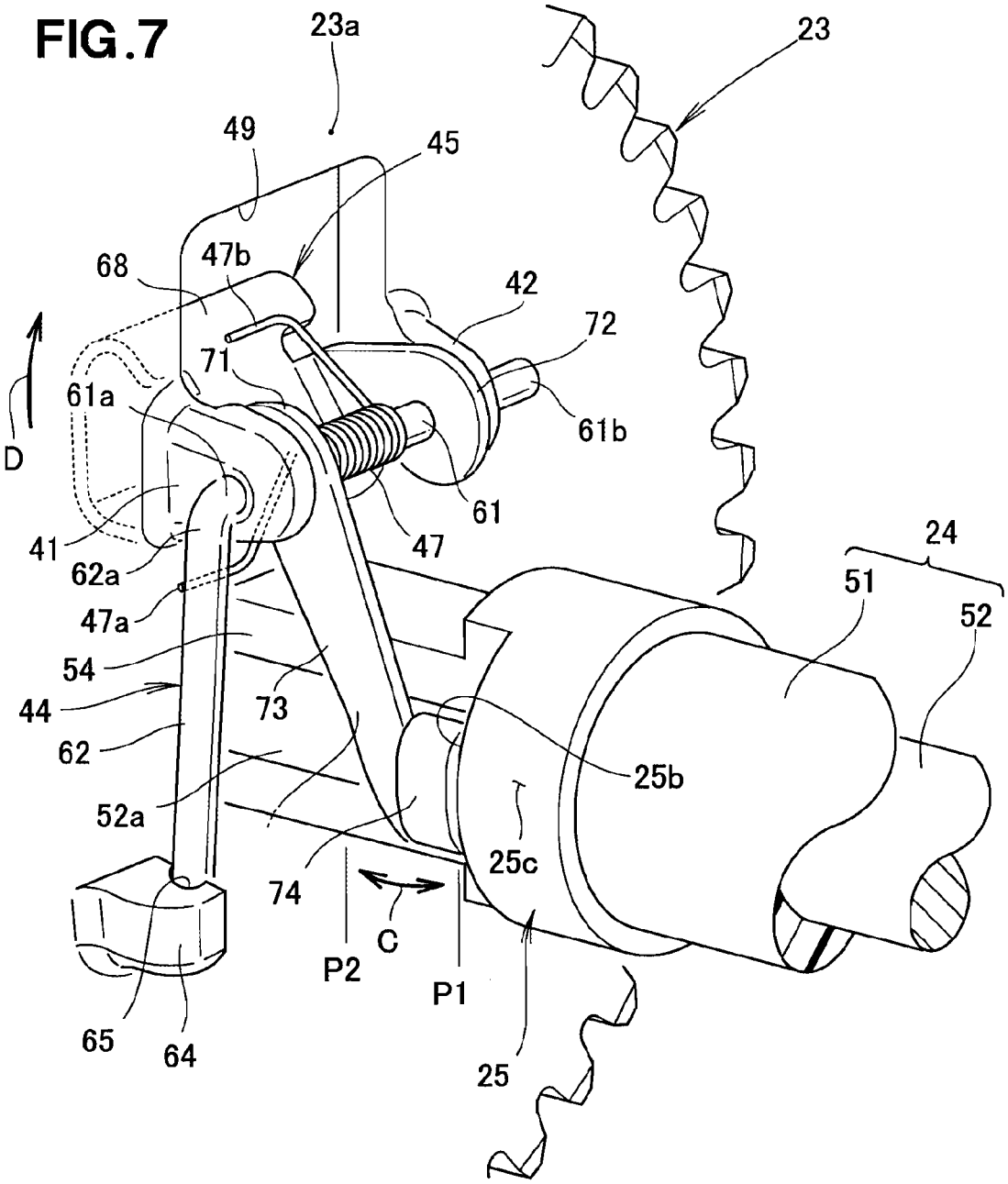
FIG. 7 is an enlarged view of a section encircled at 7 of FIG. 3.
Figure 8:
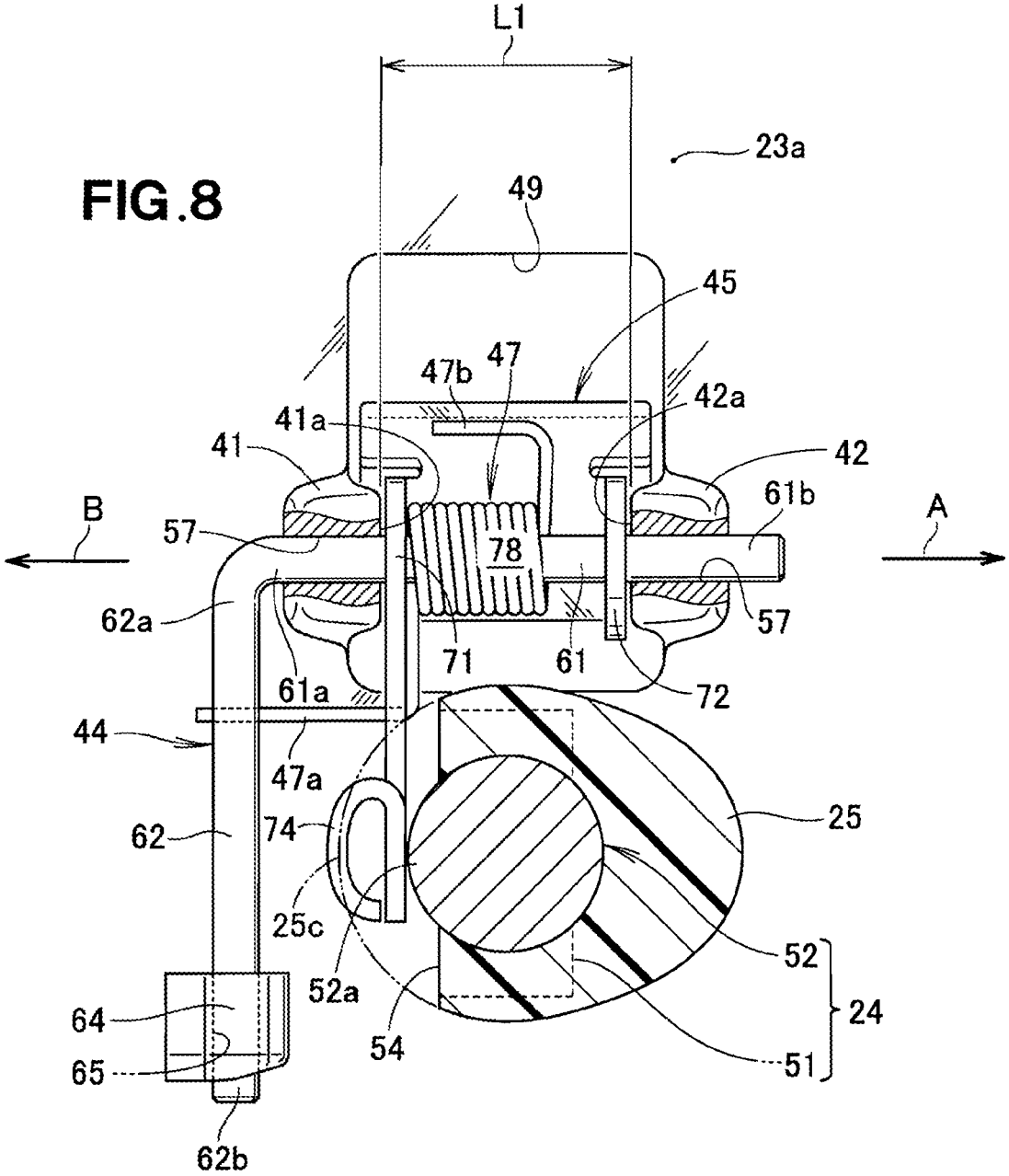
FIG. 8 is a sectional view taken along line 8-8 of FIG. 3.

Further, as shown in FIGS. 7 and 8, the pair of supporting protrusions 41 and 42 is formed of resin integrally with the wall portion 23*a* of the driven gear 23 above the camshaft 24. The supporting protrusions 41 and 42 are spaced apart from each other by the predetermined interval L1 and project toward the exhaust cam 25. Insertion holes 57 are formed coaxially through respective ones of the supporting protrusions 41 and 42, and the support shaft 44 is inserted through the insertion holes 57 of the supporting protrusions 41 and 42. Of the pair of the supporting protrusions 41 and 42, the left supporting protrusion 41 in FIG. 8 will be referred to as "the one supporting protrusion 41" while the right supporting protrusion 42 in FIG. 8 will be referred to as "the other supporting protrusion 42".

The support shaft 44 includes a horizontal shaft section 61 held in a horizontal posture by being inserted through the insertion holes 57 of the supporting protrusions 41 and 42, and a vertical shaft section 62 extending vertically downward from a proximal end portion 61*a* of the horizontal shaft section 61. With such horizontal and vertical shaft sections 61 and 62, the support shaft 44 has a generally L shape.

The horizontal shaft section 61 has a distal end portion 61*b* inserted through the insertion hole 57 of the other supporting protrusion 42 to project in a direction away from the other supporting protrusion 42. Further, the proximal end portion 61*a* of the horizontal shaft section 61 is inserted through the insertion hole 57 of the one supporting protrusion 41 to project in a direction away from the one supporting protrusion 41. In this manner, the horizontal shaft section 61 is supported in a horizontal posture by the supporting protrusions 41 and 42.

The vertical shaft section 62, extending vertically downward from the proximal end portion 61*a* of the horizontal shaft section 61, has an upper end portion 62*a* located near the pair of supporting protrusions 41 and 42. Thus, by the upper end portion 62*a* of the vertical shaft section 62 by being interfered with by the pair of supporting protrusions 41 and 42, the horizontal shaft section 61 can be prevented from slipping out in a direction of arrow A from the one supporting protrusion 41 toward the other supporting protrusion 42.

Further, the vertical shaft section 62 has a lower end portion 62*b* fitting in an engaging groove 65 of an engagement section 64. The engaging groove 65 opens toward the camshaft 24. With the horizontal shaft section 61 inserted through the insertion holes 57 of the supporting protrusions 41 and 42, the lower end portion 62*b* of the vertical shaft section 62 is brought into fitting engagement with the engaging groove 65 from the side of the camshaft 24.

In this state, the lower end portion 62*b* of the vertical shaft section 62 can be prevented by the engagement section 64 from moving away from the side of the camshaft 24. Thus, by the lower end portion 62*b* of the vertical shaft section 62, the horizontal shaft section 61 can be prevented from slipping out in a direction of arrow B from the other supporting protrusion 42 toward the one supporting protrusion 41.

Thus, there is no need to crush, bend or otherwise deform the distal end portion 61*b* of the horizontal shaft section 61 so as to prevent the horizontal shaft section 61 from slipping out in the direction of arrow B, as a result of which it is possible to reduce time and labor in assembling the decompression mechanism 20.

By preventing the horizontal shaft section 61 from slipping out in the direction of arrow B as noted above, the proximal and distal end portions 61*a* and 61*b* of the horizontal shaft section 61 can be held supported by the pair of supporting protrusions 41 and 42. The decompression member 45 is pivotably supported on the horizontal shaft section 61.

Figure 9:
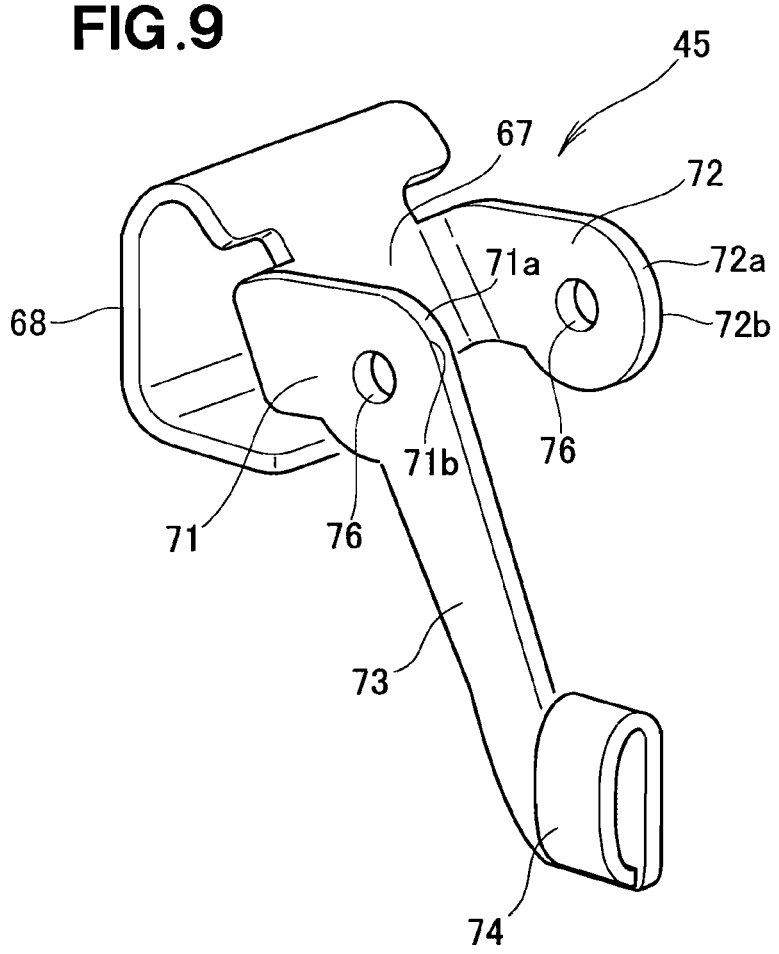
FIG. 9 is a perspective view showing a decompression member of FIG. 4.
Figure 10:
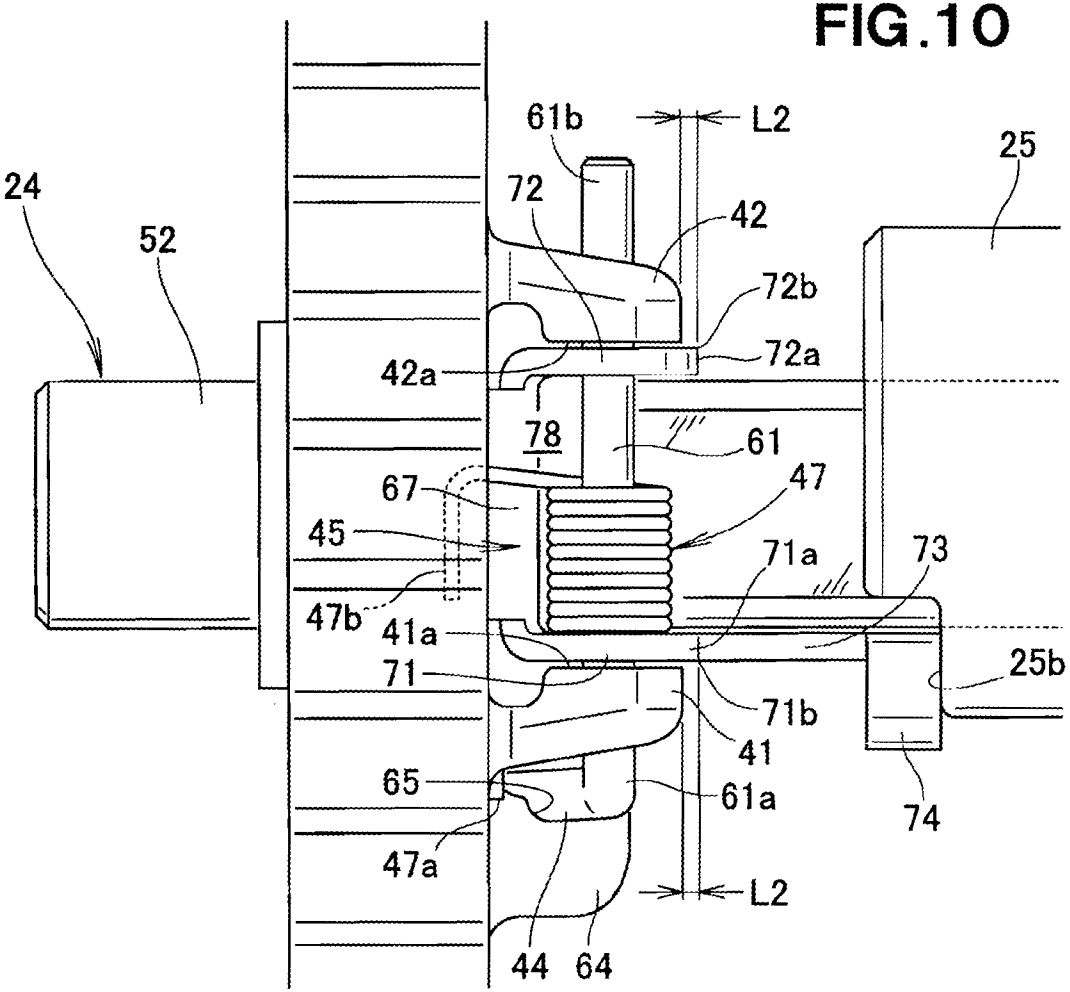
FIG. 10 is a view taken in the direction of arrow 10 of FIG. 3.

Further, as shown in FIGS. 9 and 10, the decompression member 45 is formed by bending a metal plate. The decompression member 45 includes: a base section 67 formed in a generally rectangular shape; a weight provided at the upper end of the base section 67; a pair of projections 71 and 72 provided on opposite side edges of the base section 67; an arm 73 extending from one of the projections 71 and 72; and an actuating section 74 provided at the distal end of the arm 73.

One of the pair of projections 71 extends from one side edge of the base section 67 along an inner wall 41*a* of the one supporting protrusion 41, while the other of the pair of projections 72 extends from the other side edge of the base section 67 along an inner wall 42*a* of the other supporting protrusion 41. Supporting holes 76 are formed through respective ones of the projections 71 and 72.

With the supporting holes 76 of the projections 71 and 72 fitted over the horizontal shaft section 61, the base section 67 and the pair of projections 71 and 72 are located in a space 78 between the supporting protrusions 41 and 42. In this state, the weight 68 is located in the opening portion 49 (FIG. 7) of the driven gear 23. Further, the arm 73 extends from the one projection 71 toward the exhaust cam 25, and the actuating section 74 is provided at the distal end of the arm 73.

With the pair of projections 71 and 72 located in the space 78 between the supporting protrusions 41 and 42, the one projection 71 is located adjacent to the inner wall 41 of the one supporting protrusion 41. The peripheral edge 72*a* of the other projection 72 projects beyond the other supporting protrusion 42 by a length L2 toward the exhaust cam 25.

The reason why the projections 71 and 72 project outwardly beyond the corresponding supporting protrusions 41 and 42 is as follows. The one projection 71 has a convexly-shaped corner portion 71*b* formed on the peripheral edge 71*a*. Similarly, the other projection 72 has a convexly-shaped corner portion 72*b* formed on the peripheral edge 72*a*. Thus, it is likely that the corner portion 71*b* abuts against and undesirably abrades the inner wall 41*a* of the one supporting protrusion 41, and similarly that the corner portion 72*b* abuts against and undesirably abrades the inner wall 42*a* of the other supporting protrusion 42. Thus, in the instant embodiment, the peripheral edges 71*a* and 72*b* of the projections 71 and 72 are projected outwardly beyond the supporting protrusions 41 and 42, respectively. In this way, the corner portion 71*b* can be prevented from contacting the one supporting protrusion 41 and thus prevented from abrading the inner wall 41*a* of the one supporting protrusion 41. Similarly, the corner portion 72*b* can be prevented from contacting the other supporting protrusion 42 and thus prevented from abrading the inner wall 42*a* of the other supporting protrusion 42.

Referring now back to FIG. 7, the decompression member 45 pivots in a direction of arrow C about the horizontal shaft section 61 so that the actuating section 74 moves between an actuating position P1 and a retracted position P2.

The actuating position P1 is where the actuating section 74 contacts (abuts against) a side wall 25*b* (see also FIG. 10) of the exhaust cam 25 and adjoins a base surface 25*c* of the exhaust cam 25. The actuating section 74 is formed in such a manner that, when in contact with the one outer peripheral side portion 52*a* of the core rod 52, it slightly projects beyond the base surface 25*c* (see also FIG. 8). Thus, the exhaust lifter 28 (see also FIG. 2) is raised by a slight amount by the actuating section 74 being located in the actuating position P1.

Further, the retracted position P2 is where the actuating section 74 is located away or remote from the side wall surface 25*b* of the exhaust cam 25. Thus, the actuating section 74 is located remote from the exhaust lifter 28 (see also FIG. 2) by being moved to the retracted position P2.

Further, the biasing sprint 47 is disposed between the projections 71 and 72. The biasing sprint 47 is a coil spring and supported on the support shaft 61 by its coil section being fitted over the horizontal shaft section 61. In this state, one end 47*a* of the spring 47 abuts against and presses the wall portion 23*a*, while the other end 47*b* of the biasing sprint 47 abuts against and presses the weight 68.

Thus, the arm 73 is normally biased about the horizontal shaft section 61 toward the actuating position P1 by means of the biasing sprint 47. By means of the spring or biasing force of the spring 47, the actuating section 74 is normally held in contact with the side wall 25*b* of the exhaust cam 25 and adjoining the base surface 25*c* of the exhaust cam 25.

The horizontal shaft section 61 is supported at the opposite end portions, i.e. the proximal end portion 61*a* and the distal end portion 61*b*, by the pair of supporting protrusions 41 and 42. Thus, the biasing sprint 47 is supported stably on the horizontal shaft section 61 supported at the opposite end portions by the pair of supporting protrusions 41 and 42. In this way, the spring or biasing force of the spring 47 can be applied appropriately to the arm 73, so that the decompression member 45 can operate in an appropriate manner.

Further, because the coil section of the biasing spring 47 is disposed between the pair of projections 71 and 72, the biasing spring 47 can be prevented, by the pair of projections 71 and 72, from slipping out from the horizontal shaft section 61. Thus, there is no need to provide collars or the like on the opposite ends of the spring 47 so as to prevent the biasing spring 47 from slipping out from the horizontal shaft section 61, as a result of which it is possible to reduce the number of necessary component parts of the decompression mechanism 20 and reduce time and labor in assembling the decompression mechanism 20.

Further, when the camshaft 24 rotates with less than a predetermined number of rotations at the time of activation of the internal combustion engine 10, as shown in FIGS. 2 and 7, the exhaust lifter 28 is raised by a slight amount by the actuating section 74, so that the exhaust rocker arm 32 is actuated via the exhaust push rod 31.

Thus, the exhaust value 35 is actuated by the exhaust rocker arm 32, so that the exhaust opening 38 (FIG. 1) is opened slightly. In this way, cylinder compressing force in the internal combustion chamber 10 can be reduced, so that the starting or activating operation of the internal combustion chamber 10 can be performed in an appropriate manner.

As the number of rotations of the camshaft 24 exceeds the predetermined number following the activation of the internal combustion chamber 10, the weight 68 moves by centrifugal force in a direction of arrow D against the biasing force of the spring 47. Thus, the actuating section 74 moves from the actuating position P1 to the retracted position P2, so that it gets away from the side wall 25*b* of the exhaust cam 25, i.e. from the exhaust lifter 28. In this way, it is possible to accurately open and close the exhaust valve 35 in accordance with regular operation of the internal combustion chamber 10 while preventing the exhaust lifter 28 from being raised by the actuating section 74.

As shown in FIGS. 7 and 8, the one outer peripheral side portion 52*a* of the core rod 52 is exposed through the guide recess 54, and the actuating section 74 and the distal end of the arm 73 are placed in contact with the one outer peripheral side portion 52*a*. Thus, as the decompression member 45 moves between the actuating position P1 and the retracted position P2, the actuating section 74 and the distal end of the arm 73 can slide in the direction of arrow C in contact with the one outer peripheral side portion 52*a*. Thus, it is possible to prevent abrasion of the camshaft 24 by virtue of the sliding movement of the decompression member 45 and thereby increase durability of the decompression mechanism 20.

Further, in the instant embodiment, the biasing spring 47 is disposed in the space 78 between the pair of the projections 71 and 72 and between the pair of supporting protrusions 41 and 42. Namely, the biasing spring 47 is disposed in the space 78 that has never been used in the conventionally-known counterparts. Thus, in the instant embodiment, there is no need to provide the biasing spring 47 outside the pair of supporting protrusions 41 and 42, and thus, downsizing (reduction in size) of the decompression mechanism 20 can be achieved, as a result of which the crankcase can have an increased inner space and such an increased inner space can be used efficiently.

Figure 11A:
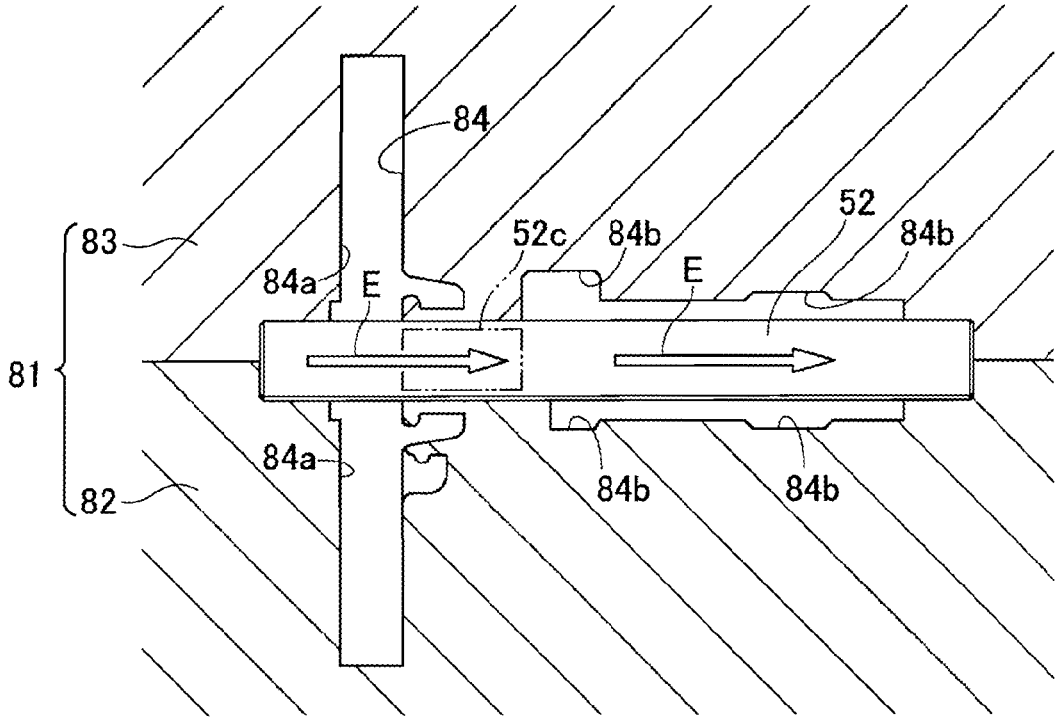
FIGS. 11A and 11B are views showing an example manner in which a camshaft, a driven gear, an exhaust cam and an intake cam are molded.
Figure 11B:
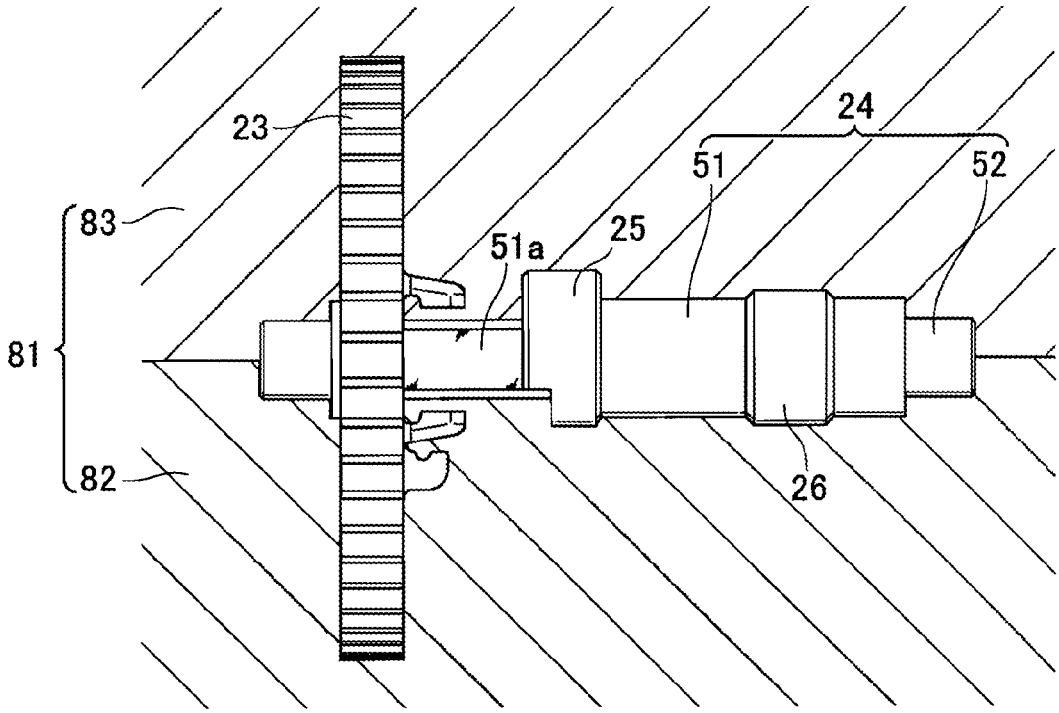

The following describe, with reference to FIGS. 11A and 11B, an example manner in which the camshaft 24, the driven gear 23, the exhaust cam 25 and the intake cam 26 are formed.

First, as shown in FIG. 11A, the core rod 52 is placed in a cavity 84 of a forming mold unit 81 with fixed and movable molds 82 and 83 clamped together. To ease understanding of resin forming, portions of the cavity 84 corresponding to the driven gear 23 (FIG. 5) will be referred to as "cavities 84*a*", and portions of the cavity 84 corresponding to the intake cam 26 (FIG. 5) will be referred to as "cavities 84*b*".

Further, the core rod 52 has an outer peripheral surface 52*c* formed as a rugged or knurled surface, having small ridges and grooves, through a knurling process. The outer peripheral surface portion 52*c* is a surface portion formed between the driven gear 23 and the exhaust cam 52 while avoiding the guide recess 54 and the balancing recess 55 (FIG. 5). In this state, molten resin is injected into the cavities 84*b* through the cavities 84*a* as depicted by arrow E until the cavity 84 is filled with the molten resin.

As noted above, the camshaft 24 has the guide recess 54 and the balancing recess 55 provided on the opposite sides thereof (see FIG. 5). Thus, the cavity 84 is formed substantially symmetrically with respect to an injected direction of the molten resin (i.e., arrow E direction). Thus, the molten resin is filled to opposite side portions of the cavity 84 substantially symmetrically with respect to the injected direction.

Further, by filling the molten resin to the opposite side portions of the cavity 84 substantially symmetrically with respect to the injected direction as noted above, the molten resin in the opposite side portions of the cavity can be solidified uniformly so that the camshaft 24, the driven gear 23, the exhaust cam 25 and the intake cam 26 are formed, as shown in FIG. 11B. In this way, it is possible to enhance formability of the camshaft 24.

Further, the outer peripheral surface portion 52*c* of the core rod 52 is formed as a rugged or knurled surface, having small ridges and grooves, through the knurling process, as noted above. Thus, the molten resin is filled into the grooves in the rugged or knurled surface 52*c*, so that sticking force between the solidified resin (i.e., part of the outer shaft portion 51) 51*a* and the knurled surface 52*c* can be greatly enhanced. In this way, the guide recess 54 and the balancing recess 55 can be provided on the opposite sides of the camshaft 24.

It should be appreciated that the internal combustion engine equipped with the decompression mechanism of the present invention is not limited to the above-described embodiment and may be modified variously. For example, whereas the internal combustion engine 10 has been described above as an internal combustion engine for an electric power generator, the present invention is not so limited, and the decompression mechanism 20 constructed in the above-described manner may be applied to internal combustion engines for use in any other apparatus, such as management machines and snow removal machines.

Furthermore, whereas the embodiment has been described above in relation to the case where the exhaust lifter 28 is actuated by the actuating section 74 of the decompression mechanism 20, the present invention is not so limited, and the camshaft 24 may be provided above the cylinder 12 so that the exhaust rocker arm 32 is activated directly by the actuating section 74.

Furthermore, whereas the embodiment has been described above in relation to the case where the decompression mechanism 20 is applied to the exhaust cam 25 (and hence the exhaust valve 35), the present invention is not so limited, and the decompression mechanism 20 may be applied to both the exhaust cam 25 and the intake cam 26.

Furthermore, the shapes and constructions of the above-described internal combustion engine 10, the decompression mechanism, the driven gear, camshaft, the exhaust cam, the pair of supporting protrusions, the support shaft, the biasing spring, the core rod, the guide recess, the balancing recess, the insertion holes, the pair of projections, etc. are modifiable as necessary without being limited to those shown and described in relation to the embodiment.

Finally, it should be appreciated that the basic principles of the present invention are well suited for application to internal combustion engines where a gear section and a cam section are formed of resin integrally with a camshaft having a metal core rod insert formed therein, and which are equipped with a decompression mechanism for securing appropriate starting performance.

What is claimed is:

1. An internal combustion engine comprising:

a camshaft having a metal core rod insert formed centrally in the camshaft, the camshaft also having a gear section and a cam section both formed integrally with the camshaft; and a decompression mechanism for securing activation of the internal combustion engine, the decompression mechanism including:

a pair of supporting protrusions provided on the gear section and each having an insertion hole formed therethrough;

a support shaft inserted through the insertion holes of the pair of supporting protrusions;

a decompression member pivotably supported on the support shaft and having a pair of projections disposed between the pair of supporting protrusions, the decompression member being movable toward and away from the cam section; and a biasing spring supported on a portion of the support shaft between the pair of projections for normally biasing the decompression member toward the cam section, wherein the camshaft also includes:

a guide recess formed in a side of the camshaft opposed to the decompression member and between the gear section and the cam section so that the decompression member is slidable along the guide recess; and a balancing recess formed in another side of the camshaft opposite the guide recess, the metal core rod being exposed through the guide recess and the balancing recess.

2. The internal combustion engine of claim 1, wherein the pair of supporting protrusions is molded of resin, the decompression member is formed of a metal material, and the projections of the decompression member project outwardly beyond the supporting protrusions.

* * * * *